US005850858A

United States Patent [19]

Zeigler

[11] Patent Number: 5,850,858

[45] Date of Patent: Dec. 22, 1998

[54] SPILLED FUEL COLLECTOR FOR BOATS

[76] Inventor: Ronald F. Zeigler, 2979 Meridith Dr., Pensacola, Fla. 32504

[21] Appl. No.: 954,021

[22] Filed: Oct. 20, 1997

[51] Int. Cl.[6] ..... B63B 25/05

[52] U.S. Cl. ..... 141/86; 141/311 A; 114/343

[58] Field of Search ..... 141/85–87, 311 A, 141/95, 383, 386; 114/343, 364, 74 R; 220/573

[56] References Cited

U.S. PATENT DOCUMENTS

| | | | |
|---|---|---|---|
| 2,555,868 | 6/1951 | Bowman | 141/86 |
| 5,230,372 | 7/1993 | Westphal | 141/86 |
| 5,762,114 | 6/1998 | Petersen | 141/86 |

*Primary Examiner*—Steven O. Douglas

[57] ABSTRACT

A spilled fuel collector for boats for attaching to an overflow vent of a boat to catch accidental spills. The device includes a pliable semi-spherical cover having an open upper end and a closed arcuate lower end. The open upper end is dimensioned for covering a fuel overflow vent of a boat. The cover has an aperture therethrough. An inner hook is secured to an inner surface of the closed arcuate lower end of the cover. The inner hook engages the fuel overflow vent of the boat in an engaged orientation. A length of hose is provided having an open upper end and an open lower end. The open upper end is secured to the aperture of the cover. The open lower end is positionable within a receptacle for transferring spilled fuel thereto.

3 Claims, 2 Drawing Sheets

SPILLED FUEL COLLECTOR FOR BOATS

BACKGROUND OF THE INVENTION

1. Field of the Invention

The present invention relates to fuel overflow control devices and more particularly pertains to a new spilled fuel collector for boats for attaching to an overflow vent of a boat to catch accidental spills.

2. Description of the Prior Art

The use of fuel overflow control devices is known in the prior art. More specifically, fuel overflow control devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art fuel overflow control devices include U.S. Pat. No. 4,013,105 to Uuskallio; U.S. Pat. No. 3,967,660 to Russell; U.S. Pat. No. Des. 296,462 to liartinan et al.; U.S. Pat. No. 4,494,585 to Waldecker; U.S. Pat. No. 4,162,020 to Kirkland; and U.S. Pat. No. 4,273,166 to Bradley.

While these devices fulfill their respective, particular objectives and requirements, the aforementioned patents do not disclose a new spilled fuel collector for boats. The inventive device includes a pliable semi-spherical cover having an open upper end and a closed arcuate lower end. The open upper end is dimensioned for covering a fuel overflow vent of a boat. The cover has an aperture therethrough. An inner hook is secured to an inner surface of the closed arcuate lower end of the cover. The inner hook engages the fuel overflow vent of the boat in an engaged orientation. A length of hose is provided having an open upper end and an open lower end. The open upper end is secured to the aperture of the cover. The open lower end is positionable within a receptacle for transferring spilled fuel thereto.

In these respects, the spilled fuel collector for boats according to the present invention substantially departs from the conventional concepts and designs of the prior art, and in so doing provides an apparatus primarily developed for the purpose of attaching to an overflow vent of a boat to catch accidental spills.

SUMMARY OF THE INVENTION

In view of the foregoing disadvantages inherent in the known types of fuel overflow control devices now present in the prior art, the present invention provides a new spilled fuel collector for boats construction wherein the same can be utilized for attaching to an overflow vent of a boat to catch accidental spills.

The general purpose of the present invention, which will be described subsequently in greater detail, is to provide a new spilled fuel collector for boats apparatus and method which has many of the advantages of the fuel overflow control devices mentioned heretofore and many novel features that result in a new spilled fuel collector for boats which is not anticipated, rendered obvious, suggested, or even implied by any of the prior art fuel overflow control devices, either alone or in any combination thereof.

To attain this, the present invention generally comprises a pliable semi-spherical cover having an open upper end and a closed arcuate lower end. The open upper end is dimensioned for covering a fuel overflow vent of a boat. The cover has an aperture therethrough disposed downwardly of the open upper end. An outer surface of the closed arcuate lower end has a button disposed thereon. An inner hook is secured to an inner surface of the closed arcuate lower end of the cover. The inner hook is opposed from the button of the cover. The inner hook engages the fuel overflow vent of the boat in an engaged orientation. A length of hose is provided having an open upper end and an open lower end. The open upper end is secured to the aperture of the cover. The open lower end is positionable within a receptacle for transferring spilled fuel thereto.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new spilled fuel collector for boats apparatus and method which has many of the advantages of the fuel overflow control devices mentioned heretofore and many novel features that result in a new spilled fuel collector for boats which is not anticipated, rendered obvious, suggested, or even implied by any of the prior art fuel overflow control devices, either alone or in any combination thereof.

It is another object of the present invention to provide a new spilled fuel collector for boats which may be easily and efficiently manufactured and marketed.

It is a further object of the present invention to provide a new spilled fuel collector for boats which is of a durable and reliable construction.

An even further object of the present invention is to provide a new spilled fuel collector for boats which is susceptible of a low cost of manufacture with regard to both materials and labor, and which accordingly is then susceptible of low prices of sale to the consuming public, thereby making such spilled fuel collector for boats economically available to the buying public.

Still yet another object of the present invention is to provide a new spilled fuel collector for boats which provides in the apparatuses and methods of the prior art some of the advantages thereof, while simultaneously overcoming some of the disadvantages normally associated therewith.

Still another object of the present invention is to provide a new spilled fuel collector for boats for attaching to an overflow vent of a boat to catch accidental spills.

Yet another object of the present invention is to provide a new spilled fuel collector for boats which includes a pliable semi-spherical cover having an open upper end and a closed arcuate lower end. The open upper end is dimensioned for covering a fuel overflow vent of a boat. The cover has an aperture therethrough. An inner hook is secured to an inner surface of the closed arcuate lower end of the cover. The inner hook engages the fuel overflow vent of the boat in an engaged orientation. A length of hose is provided having an open upper end and an open lower end. The open upper end is secured to the aperture of the cover. The open lower end is positionable within a receptacle for transferring spilled fuel thereto.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
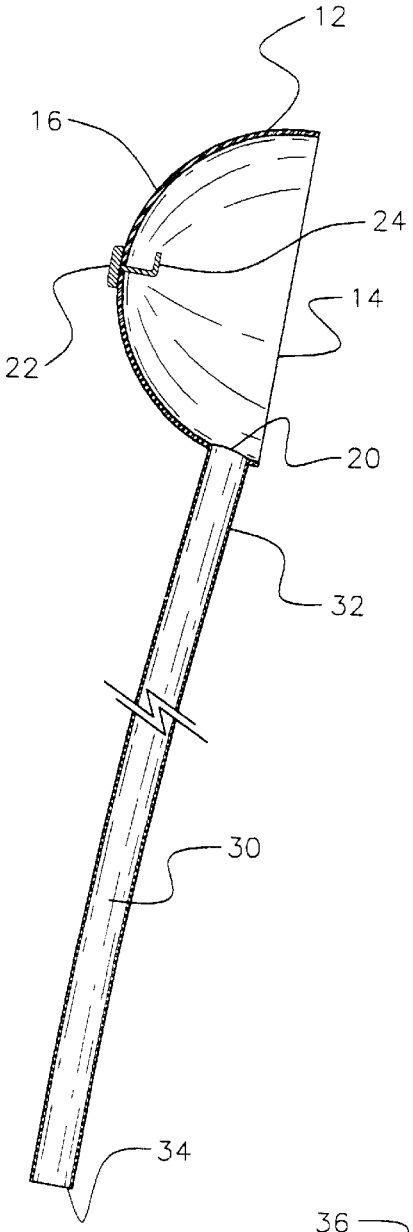
FIG. 1 is a side view of a new spilled fuel collector for boats according to the present invention shown in cross-section.
Figure 2:
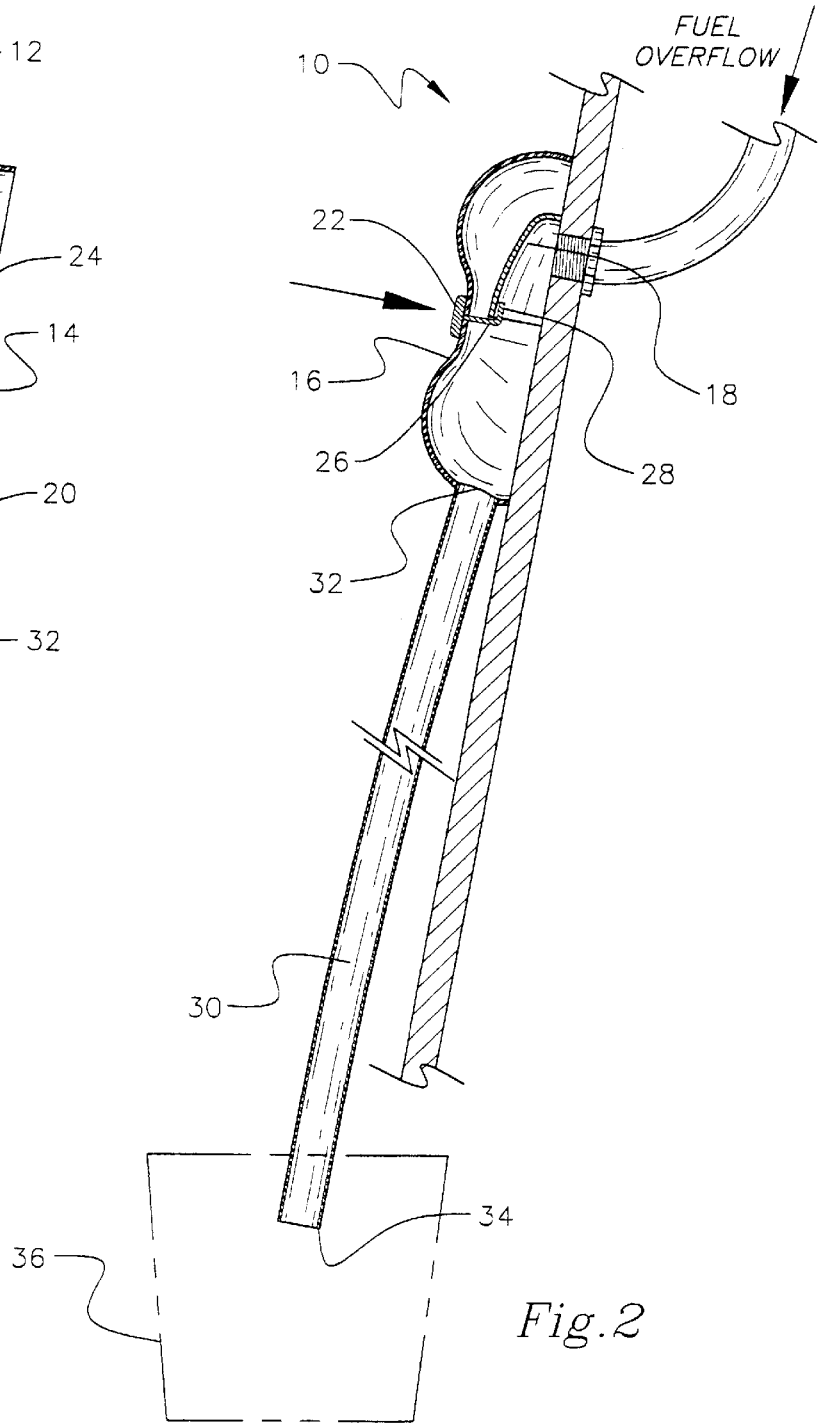
FIG. 2 is a cross-sectional side view of the present invention illustrated in use.
Figure 3:
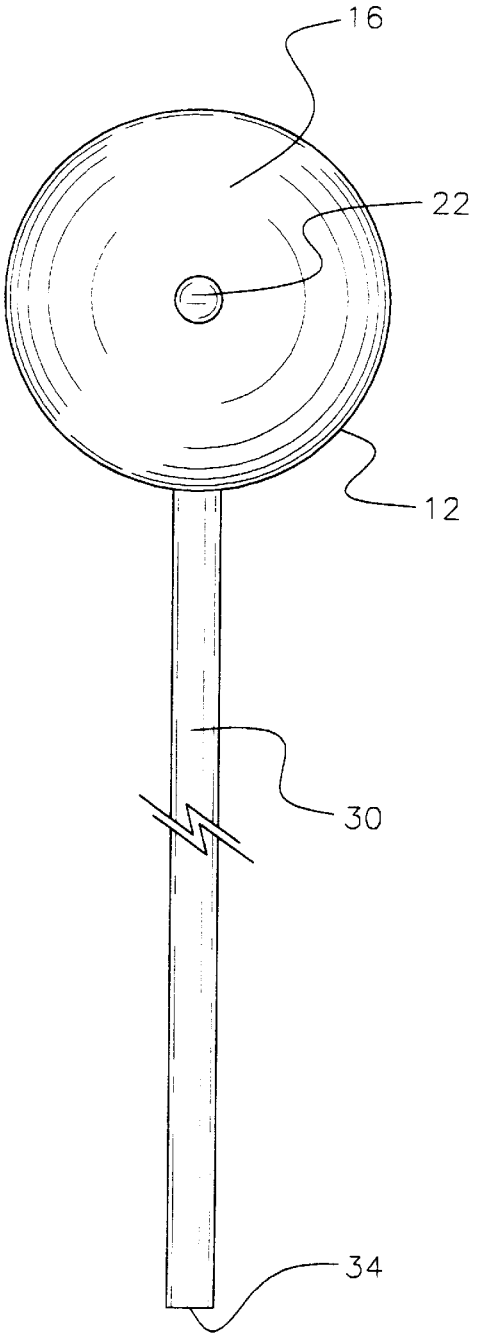
FIG. 3 is a rear elevation view of the present invention.
Figure 4:
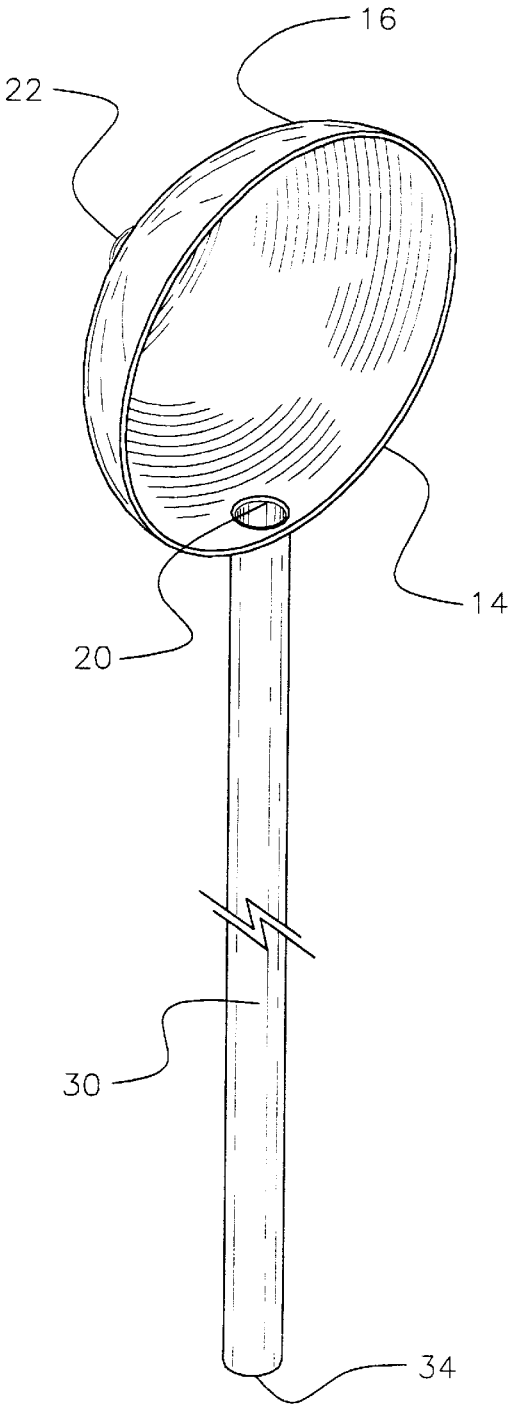
FIG. 4 is a perspective view of the present invention.

With reference now to the drawings, and in particular to FIGS. 1 through 4 thereof, a new spilled fuel collector for boats embodying the principles and concepts of the present invention and generally designated by the reference numeral 10 will be described.

As best illustrated in FIGS. 1 through 4, the spilled fuel collector for boats 10 comprises a pliable semi-spherical cover 12 having an open upper end 14 and a closed arcuate lower end 16. The open upper end 14 is dimensioned for covering a fuel overflow vent 18 of a boat. The cover 12 has an aperture 20 therethrough disposed downwardly of the open upper end 14. An outer surface of the closed arcuate lower end 16 has a button 22 disposed thereon.

An inner hook 24 is secured to an inner surface of the closed arcuate lower end 16 of the cover 12. The inner hook 24 is opposed from the button 22 of the cover 12. The inner hook 24 engages the fuel overflow vent 18 of the boat in an engaged orientation. The inner hook 24 has an L-shaped configuration including an outwardly extending horizontal segment 26 and an upwardly extending vertical segment 28. The vertical segment 28 engages the fuel overflow vent 18 in the engaged orientation.

A length of hose 30 is provided having an open upper end 32 and an open lower end 34. The open upper end 32 is secured to the aperture 20 of the cover 12. The open lower end 34 is positionable within a receptacle 36 for transferring spilled fuel thereto.

When fuel needs to be added to the marine engine tank, the device 10 would be quickly secured into place by pressing inwardly on the button 22 at the center of the rubber or soft plastic semi-spherical cover 12. Once the inner hook 24 grips an inner end of the fuel overflow vent 18, pressure could be released so the device 10 self-secures in place. If extra fuel should be released from the vent 18 during refueling, it would be contained within the cover 12 and drained down through the hose 30 into the receptacle 36 positioned therebelow. After use, the device 10 could be released and removed for storage.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A new spilled fuel collector for boats for attaching to an overflow vent of a boat to catch accidental spills comprising, in combination:

a pliable semi-spherical cover having an open upper end and a closed arcuate lower end, the open upper end dimensioned for covering a fuel overflow vent of a boat, the cover having an aperture therethrough disposed downwardly of the open upper end, an outer surface of the closed arcuate lower end having a button disposed thereon;

an inner hook secured to an inner surface of the closed arcuate lower end of the cover, the inner hook being opposed from the button of the cover, the inner hook engaging the fuel overflow vent of the boat in an engaged orientation; and a length of hose having an open upper end and an open lower end, the open upper end secured to the aperture of the cover, the open lower end positionable within a receptacle for transferring spilled fuel thereto.

2. A new spilled fuel collector for boats for attaching to an overflow vent of a boat to catch accidental spills comprising, in combination:

a pliable semi-spherical cover having an open upper end and a closed arcuate lower end, the open upper end dimensioned for covering a fuel overflow vent of a boat, the cover having an aperture therethrough;

an inner hook secured to an inner surface of the closed arcuate lower end of the cover, the inner hook engaging the fuel overflow vent of the boat in an engaged orientation; and a length of hose having an open upper end and an open lower end, the open upper end secured to the aperture of the cover, the open lower end positionable within a receptacle for transferring spilled fuel thereto.

3. The spilled fuel collector for boats as set forth in claim 2 wherein an outer surface of the closed arcuatc lower end has a button disposed thereon, the button is opposed from the inner hook.

* * * * *